United States Patent [19]

Smith

[11] Patent Number: 4,662,343

[45] Date of Patent: May 5, 1987

[54] METHOD AND APPARATUS FOR GENERATING HIGH VOLTAGE PULSES

[76] Inventor: Kenneth H. Smith, 232 High St., N. Billerica, Mass. 01862

[21] Appl. No.: 856,178

[22] Filed: Apr. 28, 1986

[51] Int. Cl.[4] ..... F02P 3/08

[52] U.S. Cl. ..... 123/605; 123/634; 315/209 CD

[58] Field of Search ..... 123/596, 598, 604, 605, 123/634; 315/209 CD, 209 SC

[56] References Cited

U.S. PATENT DOCUMENTS

| | | | |
|---|---|---|---|
| 2,896,123 | 7/1959 | McNulty | 123/598 X |
| 3,334,619 | 8/1967 | Penn | 123/637 X |
| 3,665,908 | 5/1972 | Oishi | 123/598 |
| 4,245,609 | 1/1981 | Gerry | 123/598 X |

FOREIGN PATENT DOCUMENTS

| | | | |
|---|---|---|---|
| 2623612 | 12/1977 | Fed. Rep. of Germany | 123/598 |
| 1201410 | 8/1970 | United Kingdom | 123/598 |

*Primary Examiner*—Tony M. Argenbright
*Attorney, Agent, or Firm*—E. Thorpe Barrett

[57] ABSTRACT

A control circuit operates with a small toroidal transformer, having a ferrite core, to produce high voltage pulses efficiently. The circuit applies a magnetizing force to the transformer core that is in excess of the force required to produce maximum magnetization of the core. The initial magnetizing force is opposed by current flow in the secondary winding. As the secondary current flow approaches zero, it no longer can act to demagnetize the core and the primary can generate a rapid change in magnetic strength resulting in a high voltage in the secondary winding. The rate of change of current in the primary circuit is limited by a small inductor in series with the primary winding of the transformer. The charging circuit is interrupted simultaneously with discharge of a capacitor through the transformer primary. The core is insulated for high voltage and carries a secondary winding of about 300 turns extending over about 300 degrees of the circumference and a primary winding of about three to five turns. The unit occupies only about one cubic inch of space and weighs less than two ounces. It is capable of delivering more than 10,000 volts to a discharge element in a gaseous medium that results, subsequent to breakdown, with a current of as much as one-half ampere for a period of about 0.05 microseconds.

11 Claims, 8 Drawing Figures

METHOD AND APPARATUS FOR GENERATING HIGH VOLTAGE PULSES

BACKGROUND OF THE INVENTION

1. Field of the Invention:

This invention relates to the generation of high voltage pulses and more particularly to the generation of such pulses using a small toroidal transformer and lightweight control circuitry.

2. Brief Description of the Prior Art:

The use of transformers to generate high voltage pulses has been practiced for many years. Generally, such transformers are heavy and make use of transformer windings having many turns. The constructions most generally used prevent the generators from being used in applications where light weight and small size are of critical importance. It has also been standard practice to produce high voltage pulses in such circuits by causing a sudden change in the current through the primary circuit.

SUMMARY OF THE INVENTION

Ferromagnetic materials such as are generally used as cores for high-voltage transformers exhibit hysteresis and an understanding of the the hysteresis phenomenon is necessary for an understanding of the present invention. The magnetization of such materials is represented by a plot of the magnetic induction (flux density) induced in the material by an applied magnetizing force. The induction is measured in teslas or Webers per square meter and the magnetizing force is measured in ampere-turns per meter. The magnetizing force may be created by the flow of current through a winding around the ferromagnetic core.

The relationship between the flux density and magnetizing force is non-linear with the increase of current through the transformer winding and varies from material to material. All ferromagnetic materials, however, exhibit a generally S-shaped curve. As the magnetizing force increases beyond a certain value, the corresponding flux density shows no significant increase and the material is magnetically saturated.

A conventional magnetic hysteresis loop illustrates the relationship between the flux density in the ferromagnetic material with change in the applied magnetizing force. Both the magnetic induction and the magnetizing force are vector quantities having both magnitude and direction. For an initially unmagnetized core, the flux density is zero at zero magnetizing force. As the magnetizing force is increased, the flux density increases along the magnetization curve until the saturation value is reached. Increasing the magnetizing force beyond this value produces no further increase in the flux density. As the magnetizing force is decreased from this saturation value, the flux density also decreases, but along a different curve from that followed during the increase in the magnetizing force. When the magnetizing force has returned to zero, the flux density does not return to zero, but retains a residual value. As the magnetizing force passes through zero, reversing direction, and subsequently increasing in the opposite direction, saturation again occurs, this time at a negative value. If the magnetizing force is now decreased, the flux density also decreases, but along a different path to trace the well-known hysteresis loop.

In a preferred embodiment of the present invention a control circuit operates in conjunction with a small toroidal transformer to produce high voltage pulses efficiently. The circuit applies a magnetizing force to the transformer core that is in excess of the force required to produce maximum magnetization of the core. The initial magnetizing force is opposed by current flow in the secondary winding. As the secondary current flow approaches zero, it no longer can act to demagnetize the core and the primary can generate a rapid change in magnetic strength resulting in a high voltage in the secondary winding. The rate of change of current in the primary circuit is limited by a small inductor in series with the primary winding of the transformer. A pair of contact points are arranged so that when the points are opened, the charging circuit is interrupted and simultaneously the discharge circuit through the transformer primary is activated. The transformer has a toroidal ferrite core which is insulated for high voltage and carries a secondary winding of about 300 turns extending over about 300 degrees of the circumference and a primary winding of about three to five turns. The transformer and its associated circuitry occupies only about one cubic inch of space and weighs less than two ounces. This light, compact generator is capable of delivering more than 10,000 volts to a discharge element in a gaseous medium that results, subsequent to breakdown, in a current of as much as one-half ampere for a period of about 0.05 microseconds.

DESCRIPTION OF THE PREFERRED EMBODIMENT

Figure 1:
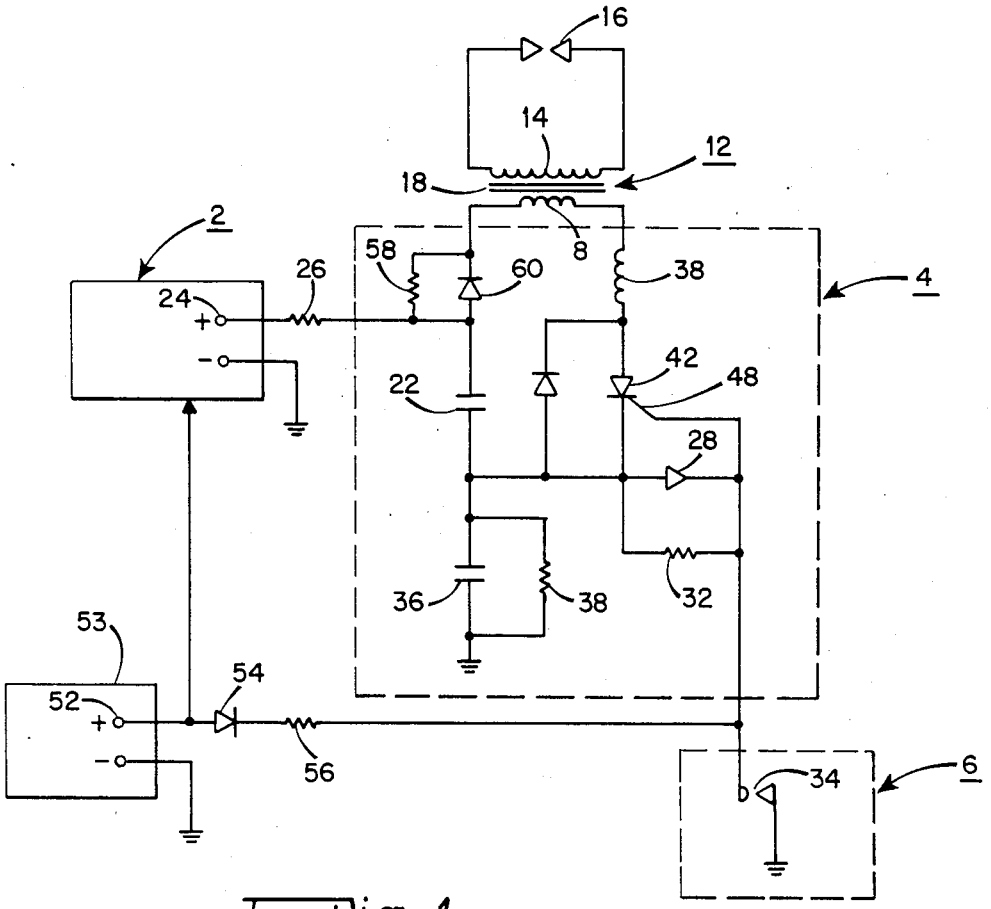
FIG. 1 is a diagram of a pulse generating system embodying the invention.

As shown in FIG. 1, a power supply, indicated in block form at 2, in this example is a dc-dc converter that increases a low level direct voltage of, say, five volts to a higher direct voltage, for example, 120 volts. The supply 2 provides power to an electronic current controller circuit, generally indicated at 4, which is connected to a switch circuit, generally indicated at 6, and to a primary winding 8 of a toroidal transformer, generally indicated at 12.

The electronic controller circuit 4 regulates the current flow in the primary winding 8 in response to triggering signals from the switch circuit 6, which in this example is a set of breaker points of the kind commonly used in ignition systems.

The secondary winding 14 of the transformer 12 is connected, for example, to a conventional spark plug, indicated diagrammatically at 16, which may form part of an internal combustion engine.

As shown in FIG. 1, one terminal of a capacitor 22 is connected to the positive high voltage terminal 24 of the supply 2 through a series resistor 26. The second terminal of the capacitor 22 is connected through a rectifier 28 and a shunt resistor 32 and the breaker points 34 to ground. Through this circuit, the capacitor 22 is charged to about 120 volts. One terminal of the capacitor 36 is connected to the second terminal of the capacitor 22 and its other terminal is connected to ground. A resistor 38 is connected in parallel with the capacitor 36. One end of the primary winding 8 is connected through the resistor 26 to the high voltage terminal 24. The other end of the primary winding is connected through a radio frequency choke 38, a silicon controlled rectifier 42, and the rectifier 28 in parallel with the resistor 32 to ground through the breaker points 34.

With the breaker points 34 closed, the capacitor 36 is not charged and both terminals are at ground potential. The capacitor 22 is charged to the full voltage of the supply terminal 24. The gate 48 of the silicon controlled rectifier 42 is at ground potential, latching it in its non-conducting state, and no current flows through the primary winding 8.

When the breaker points 34 are opened, a positive voltage of about 5 volts is applied to the gate 48, from a low voltage terminal 52 of a power supply 53, through a rectifier 54 and a series resistor 56. This drives the rectifier 42 to its conducting state permitting the capacitor 22 to discharge through the primary winding, the radio frequency choke 38 and the controlled rectifier 42.

Figure 3:
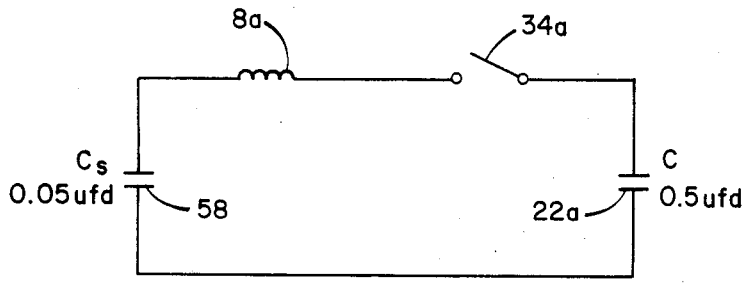
FIG. 3 is an illustrative circuit for explaining the operation of the invention.
Figure 4:
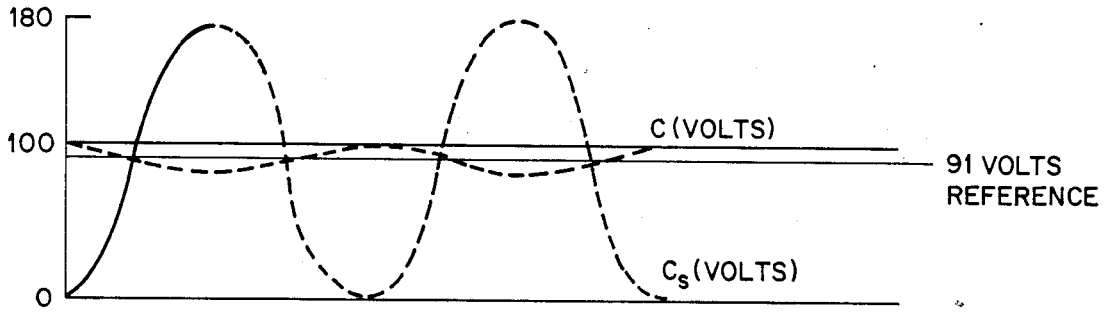
FIG. 4 shows a set of two curves illustrating the voltages appearing across the two capacitances of FIG. 3 as a function of time.

The rate at which the current flow increases through the primary winding 8 when the rectifier 42 is in its conducting state is limited by the inductance of the primary winding 8 and the inductance of the radio frequency choke 38 which is connected in series with the primary winding. In this embodiment, the choke 38 has an inductance of about 10 microhenries. The current through the choke 38 charges the capacitor 22 in the direction opposite to its initial charge, but at approximately one-half to two-thirds of its initial voltage. A diode 60 blocks the reverse flow so that a resistor 58 in parallel with the diode limits the reverse current and prevents generation of undesired signals. A current reversal occurs in the primary winding 8 which resets the transformer core 18 to its residual flux level, thereby improving the efficiency of operation. Typical values for the residual induction and maximum induction of the core 18 are 0.15 tesla and 0.5 tesla, yielding a total flux density change of about 0.65 tesla. The cross-sectional area of the ferrite core 18 is about $72\times10^{-6}$ square meter. The core switching interval between points a and c of FIG. 3 is about one microsecond and the computed voltage gradient is about 46.8 volts per turn during the core switch, a value near the maximum allowable value for the insulation employed.

In this example, the components shown in FIG. 1 have these approximate values:

Capacitor 22 : 0.47 mfd
Resistors 26 and 32 : 680 ohms
Capacitor 36 : 0.01 mfd
Resistor 56 : 1500 ohms In actual tests, the secondary voltage varied from a high of 14 kilovolts at pulse repetition rates of 0–2 pulses per second to a low of about 7.5 kilovolts at a pulse rate of 500 pulses per second. The current drain for these extreme cases varied from 38 milliamperes to 410 milliamperes, respectively. For higher repetition rates, the resistor 26 in series between the high voltage input and the capacitor 22 may be short circuited. Actual operating data of one embodiment of the invention is shown below:

| CURRENT DRAIN | PULSE RATE/SECOND | OUTPUT (VOLTS) |
|---|---|---|
| 38 milliamps | 0–2 | 14,000 |
| 80 milliamps | 40 | 12,000 |
| 90 milliamps | 50 | 12,000 |
| 140 milliamps | 100 | 12,000 |
| 210 milliamps | 200 | 10,000 |
| 290 milliamps | 300 | 8,000 |
| 410* milliamps | 500 | 7,500 |

*Resistor 26 was shorted during this test. The limitations in these test results are caused only by limitations of the power supply 2.

Figure 2:
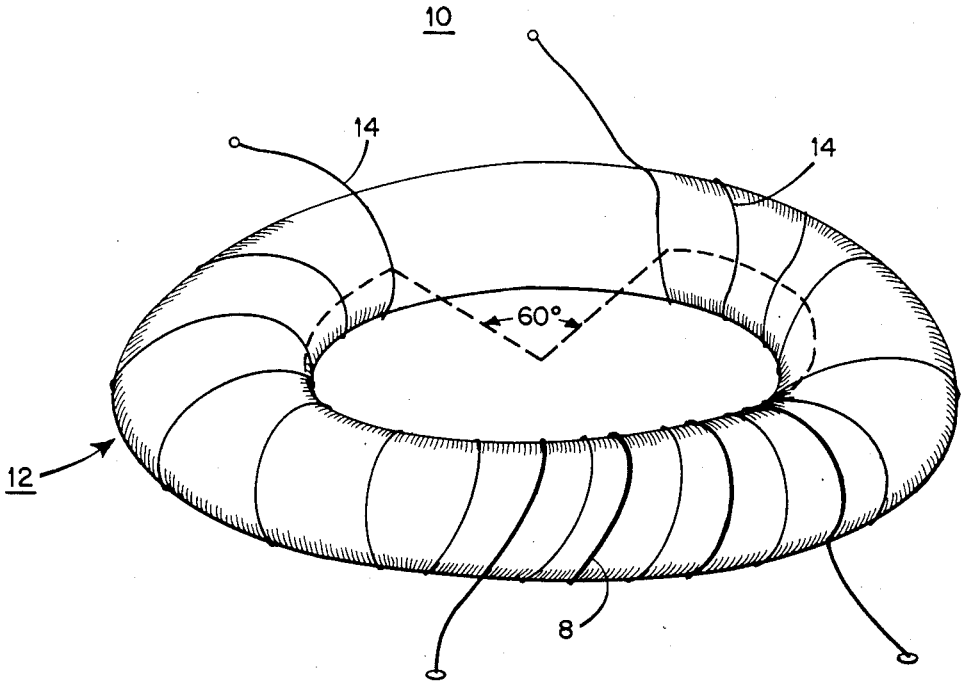
FIG. 2 is a perspective view of a toroidal transformer for use in the circuit shown in FIG. 1.

A shown in FIG. 2, the core 18 of the transformer 12 is ring shaped and is made of ferrite material. The core has an overall diameter of only about one inch, preferably between 0.75 and 1.5 inches. The core is coated with insulating material and is then wrapped with a polyimide film with a 50% overlap. The secondary winding 14 consists of 300 turns extending about 300 degrees around the core. The sixty degree gap is provided to avoid breakdown at the high voltages generated in the secondary winding. The unit is then cured overall in an epoxy. The primary winding 8, consisting of 3 turns is then wound over the secondary winding. The turns ratio of the transformer is preferably between 50:1 and 80:1 depending upon the particular application.

Figure 5:
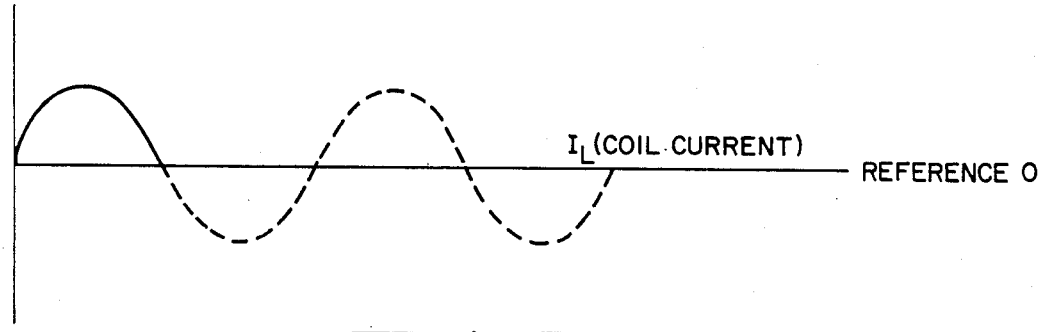
FIG. 5 illustrates the current in the circuit of FIG. 3 on the same time scale as FIG. 4.
Figure 6:
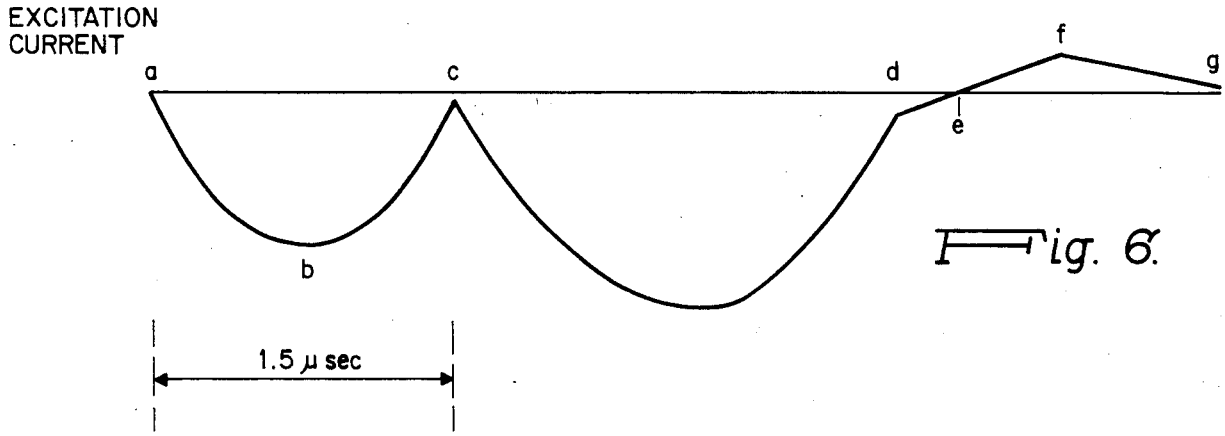
FIG. 6 illustrates the actual excitation current through the primary winding of the toroidal transformer of FIG. 2 through one complete cycle.

FIG. 3 is an approximate equivalent circuit of the pulse system in which a capacitor 58 represents the reflected capacitance into the primary winding 8 of the transformer 12 and the capacitor **22*a* represents the capacitance, for example about 0.5 ufd, in the primary circuit. The capacitance 22*a* is initially charged to 100–120 volts. When the points 34*a* are closed, an oscillation occurs and energy is exchanged through the winding 8*a*, representing the inductance of the primary winding 8 and the series rf choke 38, between the capacitances 58 and 22*a*. FIG. 5 shows the current flow through the primary winding after the points 34*a* are closed. The solid line portion of this curve is the active period when the pulse is generated: the broken line is shown only for clarity. FIG. 6 is a close approximation of the actual excitation current through the primary winding 8. Points a, b and c closely approximate the solid portion of the curve shown in FIG. 5. After about 1.5 microsecond, at point c, the core 18 of the transformer 12 becomes saturated and behaves as if the capacitance 58 were short circuited until point d is reached. Beyond point d, the core operates again in its active region and assists in reversing the polarity of the capacitor 22. It is necessary that the polarity of the capacitor 22 be reversed in order to reverse the current through the transformer primary 8 and reset the core flux at its residual level with a polarity opposite from that which it had during the pulse excitation of the transformer. The points f and g in FIG. 6 illustrate this reversal in the excitation current. The diode 28 (FIG. 1**)

and the resistor 32 are for the purpose of preventing false triggering during the charging of the capacitor 22.

Figure 7:
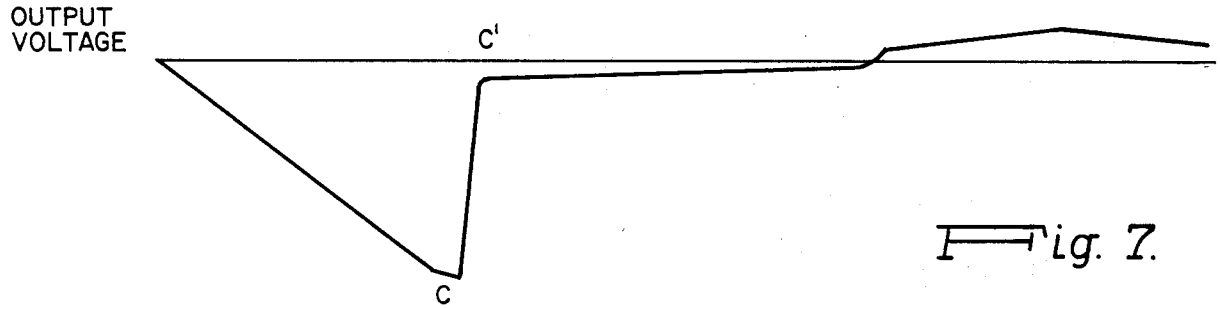
FIG. 7 shows the output voltage from the secondary winding of the transformer of FIG. 2 on a time axis corresponding to that of FIG. 6.

FIG. 7 is a plot of the output voltage from the secondary winding 14 on a time axis corresponding to that of FIG. 6. The output voltage increases linearly because of the presence of the inductor 38 in combination with the capacitor 22. The sharp drop in voltage corresponds in time with the point c in FIG. 6 when the flux reaches its maximum value and remains unchanged.

The rise in the output voltage between points a and c (FIG. 7) in this example is about 1.5 microseconds and produces a secondary voltage of about 50 volts per turn. It is during the interval of time between points a and c that the changing current in the primary winding 8 produces rapidly changing magnetic flux in the transformer core resulting in production of the high voltage pulse in the secondary winding 14. Note this switching of the magnetic core 18 occurs with near conditions in the core resulting in improved efficiency.

Figure 8:
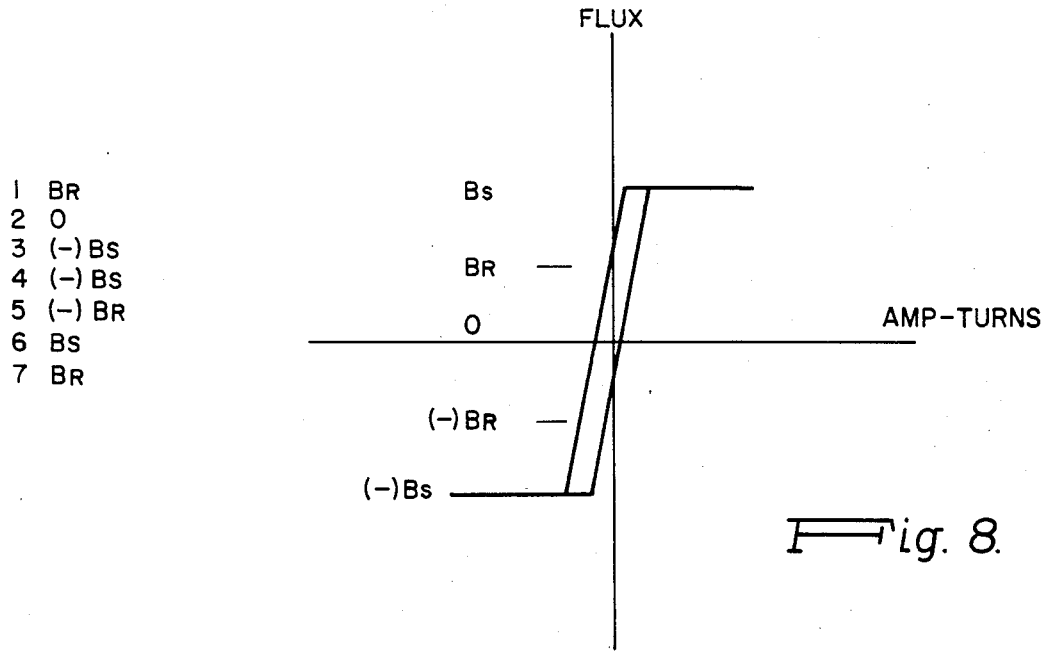
FIG. 8 is an optimized hysteresis curve showing the relationship between ampere turns and the magnetic flux density of the transformer core.

At point b in FIG. 6 the flux density of the core has reduced to zero. At point c on the same curve, the flux density has increased in the opposite direction to saturation as indicated at $-Bs$ in FIG. 8. The core remains in saturated condition while the excitation current moves from point c to point d and then to point e in FIG. 6. As the excitation current rises in the opposite direction, the flux reverses and reaches positive saturation, indicated at Bs in FIG. 8, corresponding to point f in FIG. 6. As the excitation current drops to zero, the flux returns to its original residual value at Br. The core 18 must be of high permeability material that retains substantial residual flux after the excitation is removed. A ferrite material is preferred.

The value of the inductor 38 is typically between 5 and 10 microhenries and is necessary to the proper functioning of the circuit. The value of the capacitor 22 may be about 0.47 ufd. The values of these components are selcted so that the half cycle period of the natural oscillation is between 1 and 1.5 microseconds. The flux change response of the core is selected to match that period.

Operation is enhanced by the unique triggering mechanism by which the pulse is initiated and the system is commutated simultaneously. Fault currents are eliminated. When the points 34 are closed, the charging current from the power supply 2 to the capacitor 22 is completed through the ground circuit. When the points are opened, the power supply 2 can no longer apply charging current to the capacitor while the current controller circuit 4 is simultaneoulsy triggered by the voltage from the power supply 53. The points thus simultaneously commutate the power source and trigger the excitation circuit.

I claim:

1. A method system for producing a high voltage pulse comprising the steps of providing a transformer having an annular ferrite core,
a primary winding, and
a secondary winding, providing an electronic controller circuit for controlling the current through said primary winding including
capacitance means and an rf choke connected in series with said primary winding, applying charging current to said capacitance means thereby charging it to a predetermined voltage, and simultaneously interrupting the charging circuit to said capacitance and completing circuit means to cause said capacitor to discharge through said rf choke and said primary winding.

2. The method as claimed in claim 1 wherein said rf choke has an inductance of about 10 microhenries.

3. The method as claimed in claim 1 wherein at least 7.5 kilovolts is generated in said secondary winding.

4. In apparatus for generating high voltage pulses, the combination comprising a transformer having
an annular ferrite core,
a primary winding, and
a secondary winding, an rf choke, capacitance means, circuit means connecting said choke and said capacitance means in series with said primary winding, electronic controller circuit means including charging means for applying charging current to said capacitance means to charge it to a predetermined voltage, and switch means for simultaneously interrupting said charging means and completing said circuit means thereby causing said capacitance means to discharge through said primary winding and said rf choke.

5. The combination claimed in claim 4 wherein said rf choke has an inductance of about 10 microhenries.

6. The combination claimed in claim 4 wherein said ferrite core has a cross-sectional area of about $72\times10^{-6}$ square meters.

7. The combination as claimed in claim 6 wherein said ferrite core has an overall diameter between about 0.75 inches and 1.0 inches.

8. The combination as claimed in claim 4 wherein said primary winding extends about 300° around said annular core, and said secondary winding is positoned over said primary winding.

9. The combination as claimed in claim 8 wherein the ratio of the number of turns of said secondary winding to the number of turns of said primary winding is about 100:1.

10. The combination claimed in claim 9 wherein said secondary winding has about 300 turns and said primary winding has about three turns.

11. In an ignition system, the combination comprising a spark plug, a transformer having
an annular ferrite core about one inch in overall diameter,
a secondary winding extending about 300 degrees around the perimeter of said core, and
a primary winding positioned over said secondary winding, an electronic controller circuit having
capacitance means and an rf choke connected in series, and
charging means for applying a predetermined dc voltage to said capacitance means, and switch means connected to simultaneously interrupt said charging means from said capacitance means and connect said capacitance means in series with said primary winding to allow said capacitance means to discharge through said primary winding and said rf choke.

* * * * *